US005814976A

United States Patent [19]

Allison

[11] Patent Number: 5,814,976

[45] Date of Patent: Sep. 29, 1998

[54] HIGH POWER FACTOR ELECTRONIC BALLAST

[75] Inventor: Joseph M. Allison, Euclid, Ohio

[73] Assignee: General Electric Company, Schenectady, N.Y.

[21] Appl. No.: 907,248

[22] Filed: Aug. 6, 1997

Related U.S. Application Data

[63] Continuation of Ser. No. 543,457, Oct. 16, 1995, abandoned.

[51] Int. Cl.[6] ..... G05F 1/613

[52] U.S. Cl. ..... 323/224; 323/266; 363/35; 363/89; 315/290; 315/307; 315/308

[58] Field of Search ..... 323/222–224, 323/266, 271, 283, 288, 290; 315/209 T, 209 M, 209 CD, 290–307, 308; 363/35, 89

[56] References Cited

U.S. PATENT DOCUMENTS

| | | | |
|---|---|---|---|
| 4,184,197 | 1/1980 | Cuk et al. | 363/16 |
| 5,343,140 | 8/1994 | Gegner | 323/222 |
| 5,408,403 | 4/1995 | Nerone et al. | 363/37 |
| 5,426,346 | 6/1995 | Allison | 315/209 CD |
| 5,430,405 | 7/1995 | Cohen | 327/581 |

*Primary Examiner*—Stuart N. Hecker
*Assistant Examiner*—Shawn Riley
*Attorney, Agent, or Firm*—Fay, Sharpe, Beall, Fagan, Minnich & McKee

[57] ABSTRACT

A high power factor electronic ballast for operating a high pressure gas discharge lamp comprises a boost converter function and a buck function. The boost converter function and the buck function have common components. The combination boost-buck converter reduces parts count, as compared to the parts count required for the separate boost and buck circuits of the prior art, by making some components of the single circuit act simultaneously in both the boost and buck functions. The rigid forcing of the ac input current waveform to follow the ac input voltage waveform is relaxed, to give performance priority to the buck function for the common components. Harmonics are allowed to enter the system in moderation in return for a less expensive and more reliable system that does not compromise lamp power control.

8 Claims, 3 Drawing Sheets

FIG. 3a
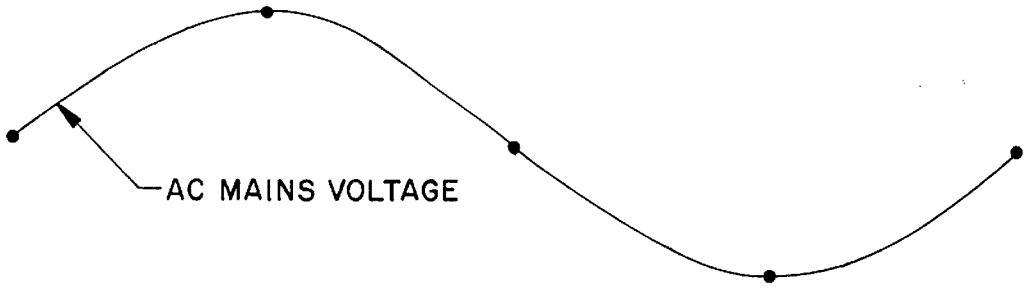
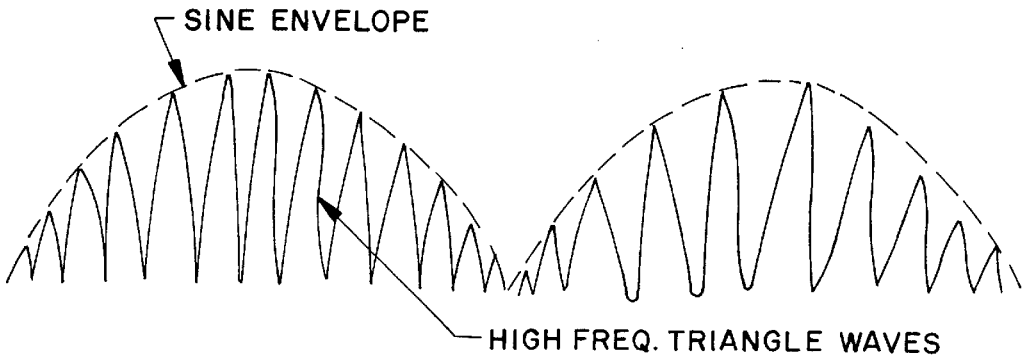
BOOST INDUCTOR CURRENT
FIG. 3b
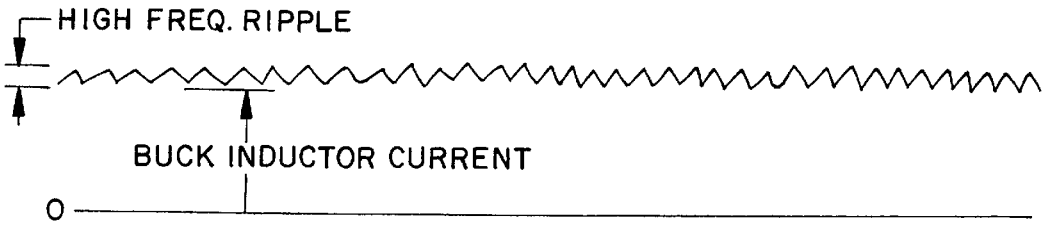
FIG. 3c
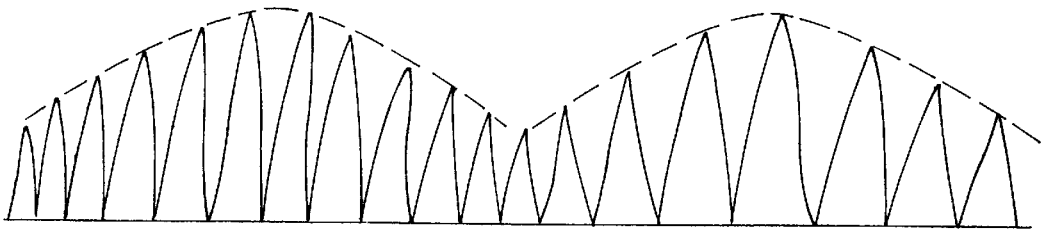
TRANSISTOR CURRENT
FIG. 3d

HIGH POWER FACTOR ELECTRONIC BALLAST

This is a continuation of U.S. application Ser. No. 08/543,457 filed Oct. 16, 1995 now abandoned.

TECHNICAL FIELD

The present invention relates generically to gas discharge lamps and, more particularly, to a high power factor ballast for use with metal halide discharge lamps.

BACKGROUND ART

Gas discharge lamps require a ballast to condition the electric utility power. These lamps require a current source, whereas the utility power is a voltage source. The essential element of a ballast is an impedance connected in series with the lamp that transforms a voltage source to a current source. Electromagnetic ballasts do the conditioning using passive components such as transformers, inductors and capacitors. Electronic ballasts contain active components, i.e., transistors and integrated circuits; as well as passive components. Electronic ballasts can convert power from one frequency to another or change the waveform of the lamp current from a sine wave to a square waveform. These conversions are impractical to do using ordinary electromagnetic ballasts. Electronic ballasts for fluorescent lamps convert the utility power frequency to a much higher frequency making fluorescent lamps deliver more light per watt of power consumed. Electronic ballasts for metal halide lamps typically deliver lamp power in the form of square waves of current, thereby eliminating flicker, which is a problem when operating these same lamps using ordinary electromagnetic ballasts. Electronic ballasts therefore add value to a lighting system beyond the capabilities of ordinary electromagnetic ballasts.

The term "static power conversion" refers to the process of converting electrical power from one form to another without the use of rotating machines. Typically, direct current, or do, is used as an intermediate form of electrical power in static power converters. For example, it may be desired to deliver power to a load in the form of high frequency ac, when the available power source is low frequency ac supplied by an electric utility company. A static power converter first converts the utility power to do. The dc power is then converted to high frequency using an electronic inverter circuit. The intermediate dc power is termed "the dc link". The dc link usually has a relatively large dc energy storage capacitor termed "the dc link capacitor" or, alternatively, "the energy storage capacitor". This capacitor smooths out any differences between the instantaneous power demanded of the dc link by the following power converter and the cyclical power delivered to the dc link by the electric utility.

In a generic sense, electronic ballasts are static power converters employing a do link. The simplest circuit capable of converting from ac to dc power consists of a solid state rectifier with a dc energy storage capacitor connected directly across the dc output terminals of the rectifier. This ubiquitous ac-to-dc power conversion circuit is used in television and radio receivers, computers, audio and video recorders, i.e., virtually all electronic products. These products require dc power to operate their circuits. Electronic ballasts also require dc power to operate their circuits and employ this simple rectifier, capacitor to operate their low power logic start-up circuits. The dc link in electronic ballasts, however, usually may not be implemented with this simple circuit because of industry regulations that limit permissable levels of harmonic currents injected into the utility power grid by lighting systems. These same regulations do not apply to other electronic products.

Undesirable harmonic currents can be injected into the electric utility system whenever the simple rectifier, dc storage capacitor combination is used to convert the ac power to dc. The process by which this occurs is briefly explained as follows. To begin with, harmonics can only be "seen" in a waveform as a distortion. Ideally, the waveform of input current for any load on the utility system would be a scaled replica of the sine waveform of the utility's ac voltage (possibly shifted in phase). Distortion and current harmonics result whenever the current waveform fails to replicate the voltage waveform, which is what happens with the rectifier, capacitor combination. The capacitor almost instantly charges up to the peak value of the ac voltage waveform. The rectifier prevents the capacitor from discharging back into the ac source so that the capacitor's voltage cannot follow the instantaneous ac voltage as it drops below its peak. The result is that current flows from the ac source only for short intervals of time near the peaks of the ac cycle. The current waveform is highly distorted because it is shorter in duration and higher in amplitude than it would be as a sine wave delivering the same average power. The distorted (pulse) waveform of current is a manifestation of current harmonics.

Ordinary electric lamps that produce light by heating a filament do not distort the current waveform. Industry regulations that limit permissible harmonic currents to a low level, in effect, require that electronic ballasts mimic an ordinary light bulb with regard to the waveform of the current demanded of the electric utility company and prohibit the pulse waveform produced by virtually all other electronic products. Therefore, electronic ballasts that meet the regulations do not use the simple rectifier, capacitor combination to implement their dc links. Electronic ballasts for low power lamps, below 25 watts, are exempt from the regulations.

Electronic ballasts that meet the most stringent requirements of international specifications with respect to permissible harmonic currents (referred to here as high power factor ballasts) usually implement their dc links in the following manner. The ac utility power is first passed through a full wave bridge rectifier. The output of the rectifier is not connected directly to the dc link capacitor but instead is connected to the input of a special power converter known (in its more general applications) as a boost converter. An example of a boost converter arrangement for a low pressure discharge lamp can be found in U.S. Pat. No. 5,408,403 issued to Nerone et al on Apr. 18, 1995, and assigned to the same assignee as the present invention. The output of this converter is connected to the dc link capacitor. The boost converter is modified from its usual form so that it is adapted to draw sine wave current from the electric utility while maintaining a constant dc link voltage. There are two versions of the adaptation. The more complex version has a multiplier stage and feedback control loop to force the ac current waveform to follow the ac voltage waveform while an additional control loop regulates the dc link voltage. The second, simpler, version omits the multiplier and the current waveform control loop and relies on operating the boost converter in the discontinuous inductor current mode, wherein the ac current waveform naturally follows (approximately) the ac voltage waveform without feedback control. This simpler version introduces some distortion but can be made to meet harmonic specifications by increasing the voltage on the dc link. The simpler form of the boost converter has the following undesirable attributes (relative to the complex form) resulting from the discontinuous current mode in which the simpler version must operate. (1) Higher voltage stress on the dc link capacitor and power switching devices that could result in lower reliability, reduced efficiency, larger product size; (2) Higher peak current in the power switching transistor and higher RMS current in the inductor that could reduce efficiency; and (3) Higher ripple current at the input of the converter that requires more filtering at the ac power mains input, which could lead to increased product size.

The impact of the above undesirable attributes is mild and acceptable especially in low power designs (less than 200 watts). Nevertheless, the only chance that the simpler version has of reducing product cost relative to the complex version is by parts count reduction, by elimination of the multiplier and a control loop. However, this incremental saving is virtually zero when additional control functions implemented by means of a monolithic integrated circuit (chip) that contains other control logic components, are utilized with either version of the boost converter. The simpler version is cost effective only because of the present high cost of special integrated circuits that contain the multiplier. Future cost reductions in these chips will relegate the simpler version of the current art to obsolete technology.

It is therefore highly desirable and an object of the present invention to provide a new and novel circuit that reduces the complexity of the high power factor electronic metal halide ballast.

SUMMARY OF THE INVENTION

In accordance with the present invention, a single, low cost, high power factor electronic ballast circuit minimizes parts count and cost, and, therefore, maximizes reliability, in achieving a high power factor. The present invention relates generically to static power converters and more particularly to electronic, high power factor, lamp ballasts for high pressure gas discharge lamps. The invention is intended for use in a metal halide ballast but may be applied to ballasts for other types of gas discharge lamps.

In accordance with one aspect of the present invention, a combination boost-buck converter is used, but with reduced parts count (as compared to the parts count required for the separate boost and buck circuits of the prior art) by making some components of the single circuit of the present invention act simultaneously in both the boost and buck functions. The precise control algorithm, wherein the current waveform is forced to follow the voltage waveform (and to do so perfectly, to achieve perfect power factor correction) used in the prior art for zero harmonics is relaxed to give performance priority to the buck function for the common components. Harmonics are allowed to enter the system in moderation in return for a less expensive and more reliable system that does not compromise lamp power control. The simultaneous use of components reduces parts count, resulting in a simplified, more economical overall circuit, while maintaining a high power factor which meets worldwide specifications for minimizing harmonics.

It is an object of the present invention to provide a circuit that combines a boost and buck converter in a way that creates a new circuit topology having the features of both a buck and boost converter using a single power switching transistor and a single logic control circuit. It is a further object of the present invention to relax the rigid forcing of the current to follow the voltage. This has the advantage of providing a simplified high power factor electronic ballast circuit, which still meets restrictions on power line harmonics.

Other objects and advantages of the invention will be apparent from the following description, the accompanying drawings and the appended claims.

BRIEF DESCRIPTION OF THE DRAWINGS

In the following detailed description, reference will be made to the attached drawings in which:

FIGS. 3*a* through 3*d* show a graphical representation of certain waveforms associated with the operation of the ballast circuit arrangement of the present invention.

DETAILED DESCRIPTION OF THE PREFERRED EMBODIMENTS

Figure 1:
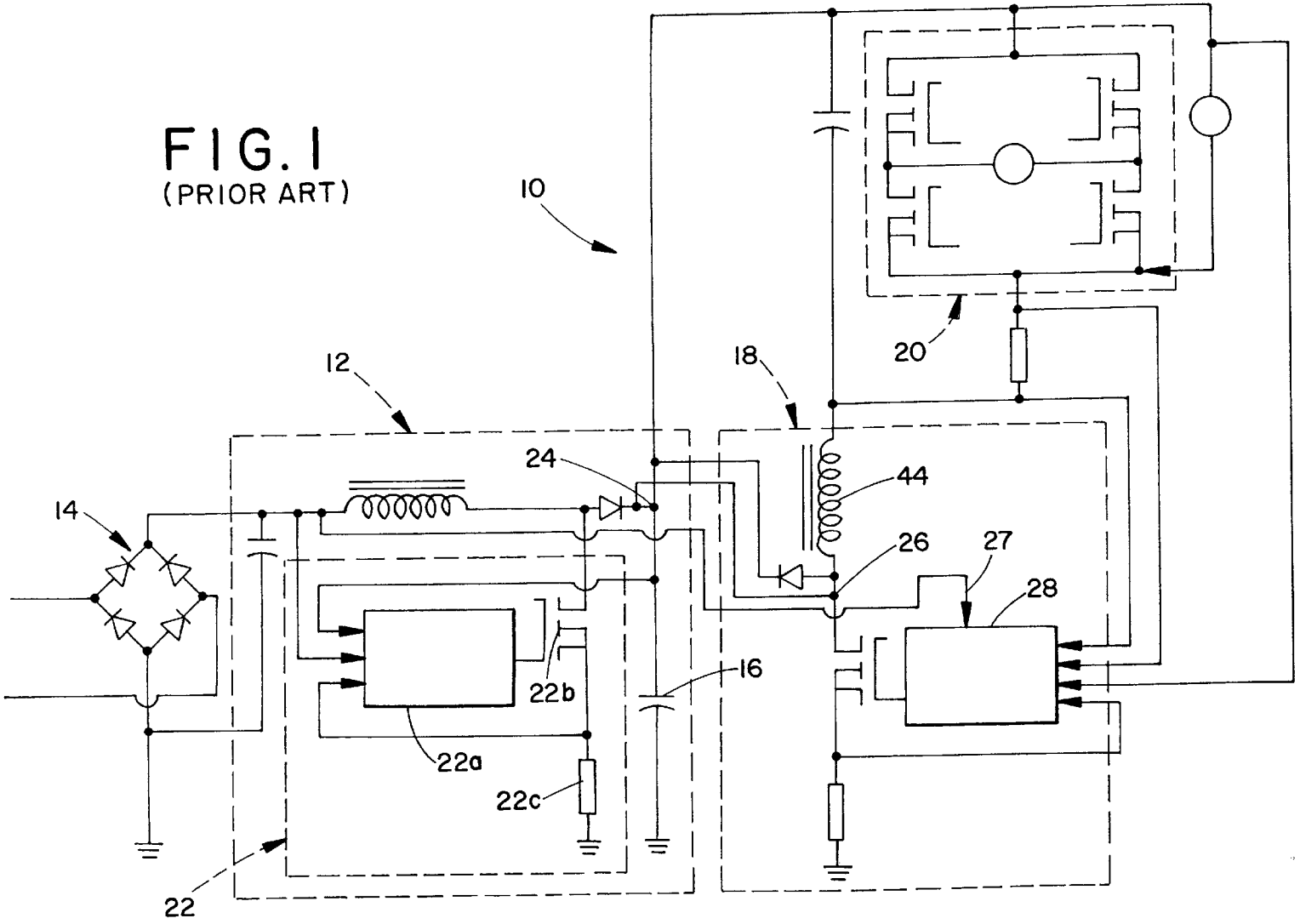
FIG. 1 (PRIOR ART)
FIG. 1 is a prior art representation of a dual circuit diagram for achieving power factor correction and lamp power control.

It is to be understood that in the following description, like reference numerals designate like or corresponding elements throughout the several figures.

The boost converter simplification that is the invention described herein goes beyond the mere elimination of a multiplier and control loop. Almost all of the boost converter circuitry, including the power switching transistor and its control logic, have been eliminated. Only the boost inductor and its series diode are retained. The boost inductor current must be discontinuous to meet harmonic specifications so the undesirable attributes of the current art simplification mentioned above remain. However, the extensive elimination of parts can make the cost effectiveness of the invention survive the inevitable future price reductions of the special chips that contain the multiplier.

To understand the invention, first refer to FIG. 1, which illustrates a simplified schematic diagram showing the essential elements of the current art, high power factor, electronic ballast for a metal halide lamp (except for the ignitor which was omitted). As seen in FIG. 1, a prior art electronic ballast arrangement for a metal halide lamp shown generally as reference 10 is effective for achieving a high power factor, but with two circuits operating independently of each other. A boost converter power factor corrector circuit 12 is located at the front end of a conventional ballast circuit which provides power factor control. Four main power conversion components or subsystems are evident in FIG. 1, including a bridge rectifier 14, the boost converter 12 to produce sine wave current loading of the ac power source, a dc energy storage capacitor 16 for the dc link, and a buck converter 18 to control lamp power. FIG. 1 further includes an optional uncontrolled dc-to-ac converter 20 to deliver ac power to the lamp (omitted for a dc lamp).

In order to achieve the benefits of the present invention whereby the operation of the ballast circuit does not result in generating unwanted and/or unacceptable harmonics and yet does so in an efficient manner in terms of the number of components (and thus cost and size of the circuit), the performance of certain of the necessary operating functions have been combined into other circuit components as will be described hereinafter in relation to FIGS. 1 and 2. For example, except for the boost inductor and its associated diode, all of the boost converter components as indicated by blocks 12 and 22, including the pulse width modulator control logic 22*a,* the transistor 22*b,* and the shunt 22*c,* of FIG. 1, have been removed. Additionally, connection changes have been made so as to enable parts of the buck converter to act as a boost converter as well as retaining all of its original buck converter functions. Last, frequency modulation 27 is input to pulse width modulator (pwm) 28 to improve harmonic reduction by modulating the switching frequency at the ac voltage waveform rate.

Figure 2:
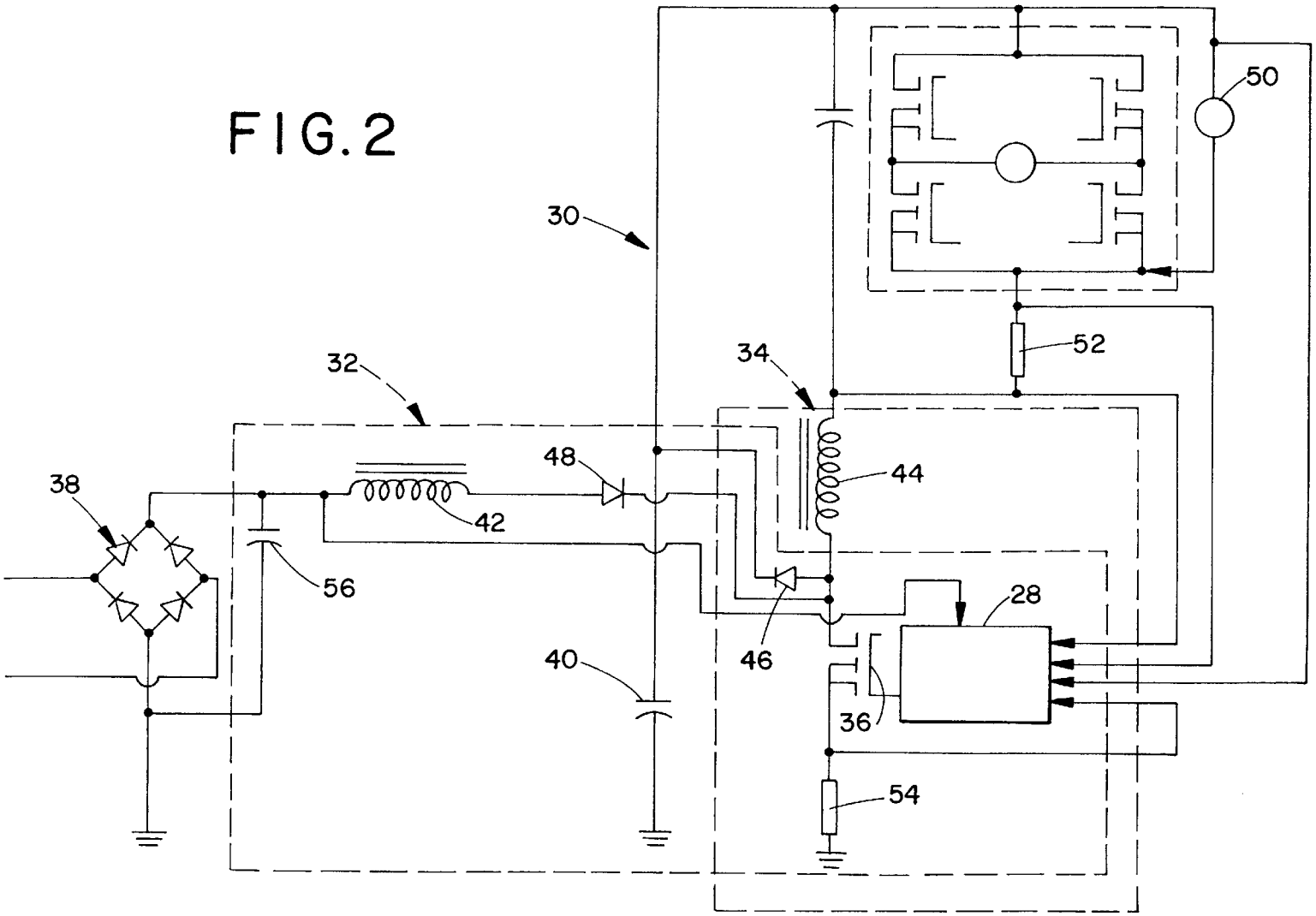
FIG. 2 is a schematic representation of one embodiment of a high power factor electronic ballast circuit constructed in accordance with the present invention.

Referring now to FIG. 2, there is illustrated an electronic ballast arrangement, shown generally as reference 30, which is effective for achieving a high power factor with minimal components and which does so by virtue of combining functions between previously separate operational components thereby lowering the number of components on the overall circuit as well as reducing the cost and size of such circuit. Moreover, the rigid forcing of the ac input current waveform to follow the ac input voltage waveform is relaxed, allowing for a simplified circuit that does not compromise lamp power control.

In the combination boost-buck converter circuit 30, certain of the circuit components act simultaneously in both the boost and buck functions, and certain of the circuit functions are shared. The boost function is achieved by the components indicated within the dotted block 32, while the buck function is achieved by the components indicated within dotted block 34.

In FIG. 2, power is chopped by transistor 36 and made to flow at high frequency from mains bridge rectifier 38 into a dc energy storage capacitor 40, through inductor 42, in boost converter fashion. At the same time, dc power from the energy storage capacitor 40 is chopped by the transistor 36 and made to flow into the load through a buck inductor 44, in buck converter fashion. Buck converter 34 free-wheeling diode 46 also functions as the free-wheeling diode for the boost converter 32. Diode 48 is added to the circuit 30 to prevent circulating current.

To achieve the required harmonic current reduction, the boost inductor 42 must be sized to result in fully discontinuous current throughout the range of operation from minimum to maximum ac voltage and lamp voltage. The boost inductor current must not be overly discontinuous or loss of efficiency and excessive dc link voltage will result. Therefore, in a preferred embodiment, the boost inductor 42 should be sized to just barely meet the discontinuous current requirement at the extreme operating point of minimum lamp voltage and minimum ac mains voltage. Even after satisfying this boost inductor requirement, the third harmonic remains particularly troublesome. To reduce the third harmonic, the dc link voltage can be increased. Unfortunately, increasing voltage is undesirable. The degree to which the dc link voltage must be raised is moderated by the use of frequency modulation of the pwm switch cycle. The frequency modulation input is taken from the output of the rectifier 38 so that the pwm switching frequency sweeps in unison with the ac line voltage, causing the switching frequency to be maximum at the peaks of the ac cycle and minimum at the zero-crossings of the ac cycle. As seen in FIGS. 3*a* through 3*d,* the relationship between the various waveforms discussed herein, have been illustrated. Increasing the switching frequency as the ac input voltage rises throughout its cycle causes the impedance of the boost inductor to rise and become maximum at the peaks of the ac cycle. This modulation of the impedance causes the peak ac current to be lowered in comparison to the average current. In general, third harmonic distortion causes waveform peaking so that the lower peak current is a manifestation of a lower third harmonic. The optimum frequency sweep ratio is 2:1 with the peak frequency being double the minimum frequency. As will be obvious to those skilled in the art, the frequency modulation is not necessary to practice the invention. However, it is an enhancement feature that improves performance by making the ballast meet the third harmonic reduction requirement at a lower dc link voltage than would otherwise be possible.

The pwm control logic 28 converts analog control signals into a train of pulses that are width-modulated. The transistor 36 is turned on and off by the pulses. The pulse duty (that is, its on time to total time ratio) determines the average current in lamp 50. The purpose of the pwm control logic 28 is to determine this duty ratio to satisfy the control signal inputs of lamp current feedback and lamp voltage feedback. The pwm control logic 28, transistor 36, lamp 50 and feedback signals form a control loop in which the lamp power is regulated and held constant against changes in input voltage and lamp voltage.

Lamp 50 power is directly controlled in buck converter fashion. The duty cycle of the switching transistor 36 is strictly determined by feedback control of the lamp power. The input power that is transferred in boost converter fashion between the mains rectifier 38 and the dc energy storage capacitor 40 is not directly controlled.

A shunt resistor 52 connected in series with the lamp 50 provides a lamp current feedback signal to pwm control logic 28. The purpose of this signal is to monitor lamp current so that it can be controlled. Shunt resistor 54, connected in series with transistor 36 provides a transistor current feedback signal to the pwm control logic 28. The purpose of this signal is to monitor transistor current so that it can be controlled. This signal is optional, as the invention could be practiced without it.

Bridge rectifier capacitor 56 provides a low impedance for the switching ripple current that flows in the boost inductor 42. The capacitor 56 prevents excessive amounts of switching ripple current from entering the ac power mains input. The diode 48 prevents circulating current between the two capacitors 40 and 56.

A surprising result of the circuit of the present invention is that the input power that flows in boost converter fashion that is not directly controlled is nevertheless well behaved. After optimizing the inductance of 42, the circuit 30 yielded a mains power factor of at least 96%, with a total harmonic distortion of 23%, and an efficiency of at least 88%, while operating a 60 watt lamp 50 from 120 volt AC power supply. All harmonics were within required limits.

The invention has been described in detail with particular reference to certain preferred embodiments thereof, but it will be understood that modifications and variations can be effected within the spirit and scope of the invention.

What I claim as new and desire to secure by Letters Patent of the United States is:

1. A high power factor electronic ballast for operating a high pressure gas discharge lamp comprising:

a boost converter function; and a buck function;

wherein the boost converter function and the buck function have common components;

wherein the common components comprise a single power switching transistor;

wherein the single power switching transistor chops power to flow at high frequency from a mains bridge rectifier, into a dc energy storage capacitor, and through a boost inductor in boost converter fashion; and wherein the high power factor electronic ballast accepts ac power as an input and produces dc power as an output.

2. A high power factor electronic ballast as claimed in claim 1 wherein performance priority is given to the buck function for the common components.

3. A high power factor electronic ballast as claimed in claim 1 wherein the single power switching transistor chops dc power from the energy storage capacitor to flow into the lamp through a buck inductor in buck converter fashion.

4. A high power factor electronic ballast as claimed in claim 1 wherein the boost inductor is sized to result in fully discontinuous current throughout a minimum to maximum operating range of ac voltage and lamp voltage.

5. A high power factor electronic ballast as claimed in claim 4 wherein the boost inductor is sized to just barely meet the discontinuous current requirement at an extreme operating point of minimum lamp voltage and minimum ac mains voltage.

6. A high power factor electronic ballast as claimed in claim 1 wherein the common components comprise a single logic control circuit.

7. A method for modifying a high power factor electronic ballast having a plurality of boost converter functions and further having a buck converter, the method comprising the steps of:

inputting ac power to the high power factor electronic ballast;

removing all of the plurality of boost converter components, except for a boost inductor and a boost diode;

implementing connecting changes to make the buck converter act as a boost converter, while retaining all original buck converter functions;

providing a frequency modulation input to a pulse width modulator to improve harmonic reduction; and producing dc output power from the electronic ballast.

8. A method for modifying a high power factor electronic ballast as claimed in claim 7 wherein the step of providing a frequency modulation input further comprises the step of modulating switching frequency at an ac voltage waveform rate.

* * * * *